US005564545A

United States Patent [19]

Suzuki

[11] Patent Number: 5,564,545

[45] Date of Patent: Oct. 15, 1996

[54] PAPER CURRENCY ACCEPTOR

[75] Inventor: Yasuo Suzuki, Tokyo, Japan

[73] Assignee: Universal Sales Co., Ltd., Tokyo, Japan

[21] Appl. No.: 520,240

[22] Filed: Aug. 28, 1995

[30] Foreign Application Priority Data

Sep. 1, 1994 [JP] Japan ..... 6-208500

[51] Int. Cl.[6] ..... G07F 7/04

[52] U.S. Cl. ..... 194/206; 194/350; 271/180

[58] Field of Search ..... 194/206, 207, 194/350; 271/180, 181; 232/15, 16

[56] References Cited

U.S. PATENT DOCUMENTS 5,251,738 10/1993 Dabrowski ..... 194/206

5,419,423 5/1995 Ishida et al. ..... 194/206

*Primary Examiner*—F. J. Bartuska

*Attorney, Agent, or Firm*—Rohm & Monsanto

[57] ABSTRACT

A paper currency acceptor receives paper currency and stores the paper currency therein. A paper currency validator verifies validity of paper currency temporarily received from the outside of the paper currency acceptor to validate or reject the paper currency. A removable paper currency storage unit stores the paper currency validated by the paper currency validator. The paper currency is transferred to the paper currency storage unit. The paper currency transferred is displaced into the paper currency storage unit for storage therein. A drive source is provided for displacing the paper currency. The paper currency storage unit is locked to inhibit the paper currency storage unit from being removed from the paper currency acceptor. In the paper currency acceptor, the drive source is provided separately from the paper currency storage unit, and the drive source supplies driving force the locking/unlocking operation.

12 Claims, 13 Drawing Sheets

PAPER CURRENCY ACCEPTOR

BACKGROUND OF THE INVENTION

1. Field of the Invention

This invention relates to a paper currency acceptor for slot machines and other gaming machines, as well as vending machines (hereinafter referred to as "gaming machines and the like").

2. Prior Art

Conventionally, a paper currency acceptor has been used in gaming machines and the like, which comprises a bill validator for validating or rejecting paper currency, i.e. a bill, which is inserted via a receiving slot, a paper currency storage unit (hereinafter referred to as "stacker") housed within the body of the acceptor for storing received paper currency, and conveyor means for transferring the bill from the bill validator to the stacker. The stacker incorporates paper currency-displacing means, as well as a drive source, such as a motor, for driving the paper currency-displacing means.

In such a paper currency acceptor, the stacker is formed as a unit removable from the acceptor. That is, when it is loaded in the acceptor, it is fixed thereto by a manual locking operation, and it is unlocked before removing the same from the paper currency acceptor.

However, the paper currency acceptor employing the stacker of the manual lock type described above is susceptible to vandalism, since the stacker storing paper currency therein can be easily removed therefrom. Therefore, to enhance security of the acceptor and reduce the labor of collectors who collect stackers, the provision of an automatic locking mechanism is contemplated for automatically locking the stacker to the acceptor and unlocking the former from the latter. In this case, however, a drive source, such as a solenoid or an electric motor, is necessitated for driving the automatic locking mechanism, which requires an additional space and increased manufacturing cost. Further, if the drive source is incorporated into the stacker together with the locking mechanism, the weight of the stacker increases to lay an increased burden on a collector who removes and carries off the stacker.

SUMMARY OF THE INVENTION

It is an object of the invention to provide a paper currency acceptor with an improved security over the prior art, which is capable of automatically locking and unlocking a stacker with its inexpensive and compact structure, while avoiding an increase in weight of the stacker.

A paper currency acceptor of the present invention includes:

paper currency-validating means for verifying validity of paper currency temporarily received from the outside of the paper currency acceptor to validate or reject the temporarily received paper currency;

a paper currency storage means removable from the paper currency acceptor for storing the paper currency validated by the paper currency-validating means;

conveyor means for transferring the paper currency from the paper currency-validating means to the paper currency storage means;

paper currency-displacing means for displacing the paper currency transferred from the conveyor means into the paper currency storage means for storage therein;

a drive source for driving the paper currency-displacing means; and locking/unlocking means for locking the paper currency acceptor to make it impossible to remove the paper currency storage means from the paper currency acceptor.

The paper currency acceptor according to the invention is characterized in that the drive source is provided separately from the paper currency storage means, and the locking/unlocking means is driven by the drive source for locking and unlocking operations thereof.

According to the paper currency acceptor of the invention, when paper currency is sent to the paper currency-validating means, the paper currency-validating means verifies the paper currency as to its authenticity and value. The paper currency, if determined to be acceptable, is sent from the paper currency-validating means to the paper currency storage means. The paper currency-displacing means displaces the paper currency into the paper currency storage means. In doing this, the paper currency-displacing means is driven by the drive source arranged separately from the paper currency storage means. The removable paper currency storage means loaded in a body block of the paper currency acceptor is locked or unlocked by the locking/unlocking means. The locking/unlocking means is actuated by driving force transmitted from the drive source.

In the paper currency acceptor of the present invention, the paper currency storage means can be automatically locked and unlocked by the locking/unlocking means, and the locking/unlocking means is driven not by a newly provided drive source but by the drive source for supplying the driving force to the paper currency-displacing means. Therefore, it is possible to enhance the security of the paper currency acceptor, as well as to avoid an increase in the weight of the paper currency storage means and paper currency-displacing means and an increase in space, which would otherwise be caused for driving the locking/unlocking means. Therefore, there is provided the paper currency acceptor which is reduced in manufacturing cost, and automated in locking/unlocking operations thereof, while reducing the labor of operators who collect and load paper currency storage means.

Preferably, the locking/unlocking means is arranged between the drive source and the paper currency-displacing means.

According to the paper currency acceptor of the preferred embodiment, since the locking/unlocking means is arranged between the drive source and the paper currency-displacing means, the driving force transmitted from the drive source provided separately from the paper currency storage means is directly utilized to drive the locking/unlocking means. In other words, it is possible to omit the labor and cost required for providing a mechanism for transmitting the driving force from the drive source to the locking/unlocking means, independently of or in addition to one for transmitting the driving force from the drive source to the paper currency-displacing means, which contributes to attaining the reduction of space and cost.

More preferably, the locking/unlocking means comprises a drive shaft driven by the drive source for rotation to transmit driving force from the drive source to the paper currency-displacing means, a pair of cams arranged on the drive shaft, with one-way clutches interposed between one of the pair of cams and the drive shaft and between the other of the pair of cams and the drive shaft, respectively, with one of the one-way clutches for one of the pair of cams and the other of the one-way clutches for the other of the pair of cams being opposite in the direction of rotation occurring in unison with the drive shaft for transmitting the driving force.

According to this preferred embodiment, since one of the one-way clutches for one of the pair of cams and the other of the one-way clutches for the other of the pair of cams are opposite in the direction of rotation in unison with the drive shaft, the locking or unlocking operation can be automatically performed according to the direction of rotation (the normal or reverse rotation) of the drive shaft.

Further preferably, the locking/unlocking means includes a pair of rods which are capable of being displaced in opposite directions according to the rotation of one of the pair of cams, and when the drive shaft is driven by the drive source for rotation in a locking direction, the pair of rods are actuated outward by the one of the pair of cams so as to be retained in respective locking positions in which the pair of rods are projected out of the paper currency acceptor.

This preferred embodiment makes it possible to utilize the driving force of the drive shaft in the locking operation in a simple and reliable manner.

Still more preferably, the pair of rods have grooves for engagement with retaining means for retaining the rods in the respective locking positions, and the retaining means is disengaged from the grooves according to rotation of the other of the pair of cams.

Preferably, the paper currency storage means, the paper currency-displacing means, and the locking/unlocking means are arranged in one housing to form a unit removable from the paper currency acceptor.

Preferably, the rods are projected out of the housing when they are in the locking positions.

Preferably, the paper currency acceptor includes control means for delivering a locking drive signal to the drive source to thereby cause the locking/unlocking means to be driven in the locking direction.

According to this preferred embodiment, it is possible to control the locking/unlocking operation of the locking/unlocking means properly.

Preferably, the paper currency acceptor includes a detector for detecting loading of the paper currency storage means when the paper currency storage means is loaded in the paper currency acceptor, and delivering a signal indicative of detection of the loading of the paper currency storage means to the control means, and the control means delivers the locking drive signal to the drive source in response to the signal from the detector.

According to this preferred embodiment, it is possible to automatically lock the paper currency storage means in a reliable manner.

Preferably, the control means delivers an unlocking drive signal to the drive source in response to a predetermined unlocking operation signal, to thereby cause the locking/unlocking means to be driven in an unlocking direction.

Preferably, the paper currency acceptor is housed within a machine, such as a gaming machine, and the predetermined unlocking operation signal is generated when a card having predetermined information recorded therein is inserted into the machine and the predetermined information is read therefrom.

Alternatively, the paper currency acceptor is housed within a machine, such as a gaming machine, and the predetermined unlocking operation signal is generated when a front door of the machine is unlocked or opened.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
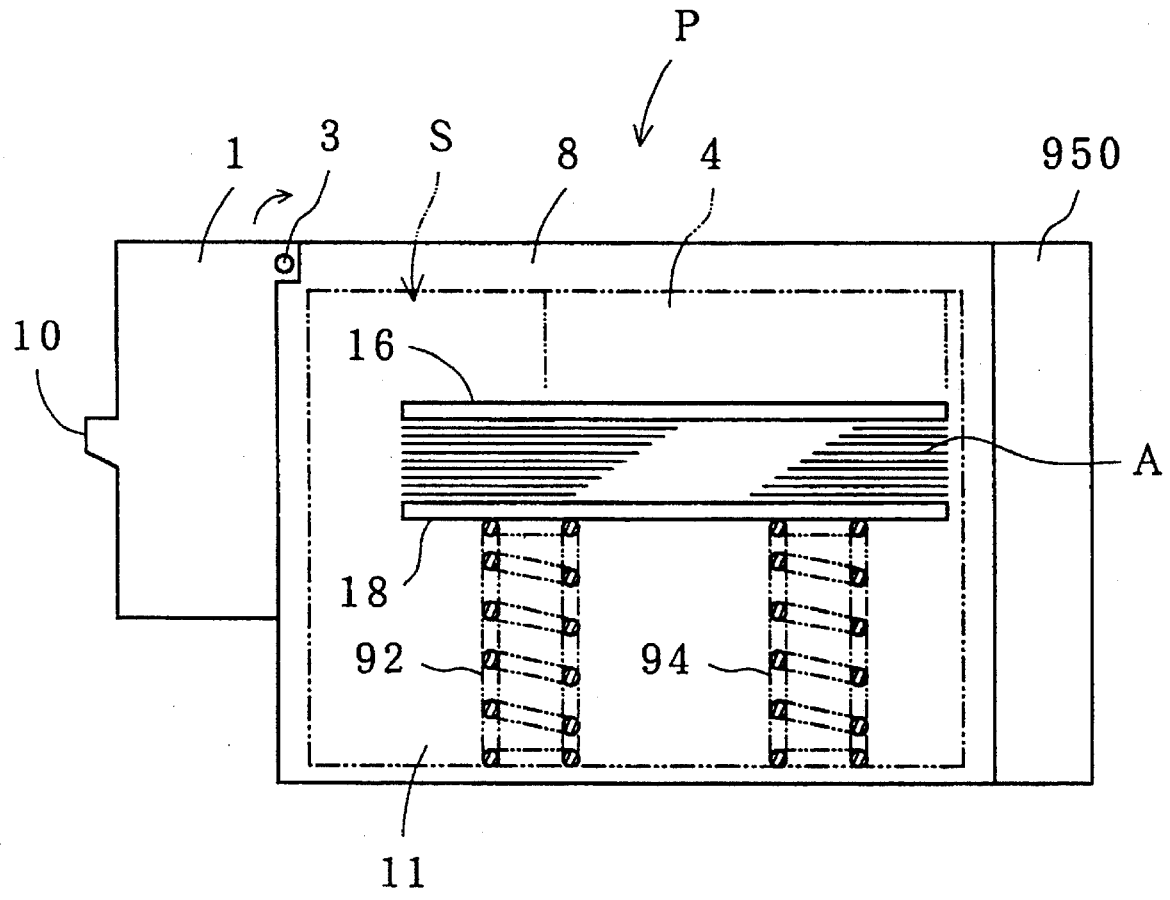
FIG. 1 is a schematic view of the construction in outline of a paper currency acceptor.
Figure 2:
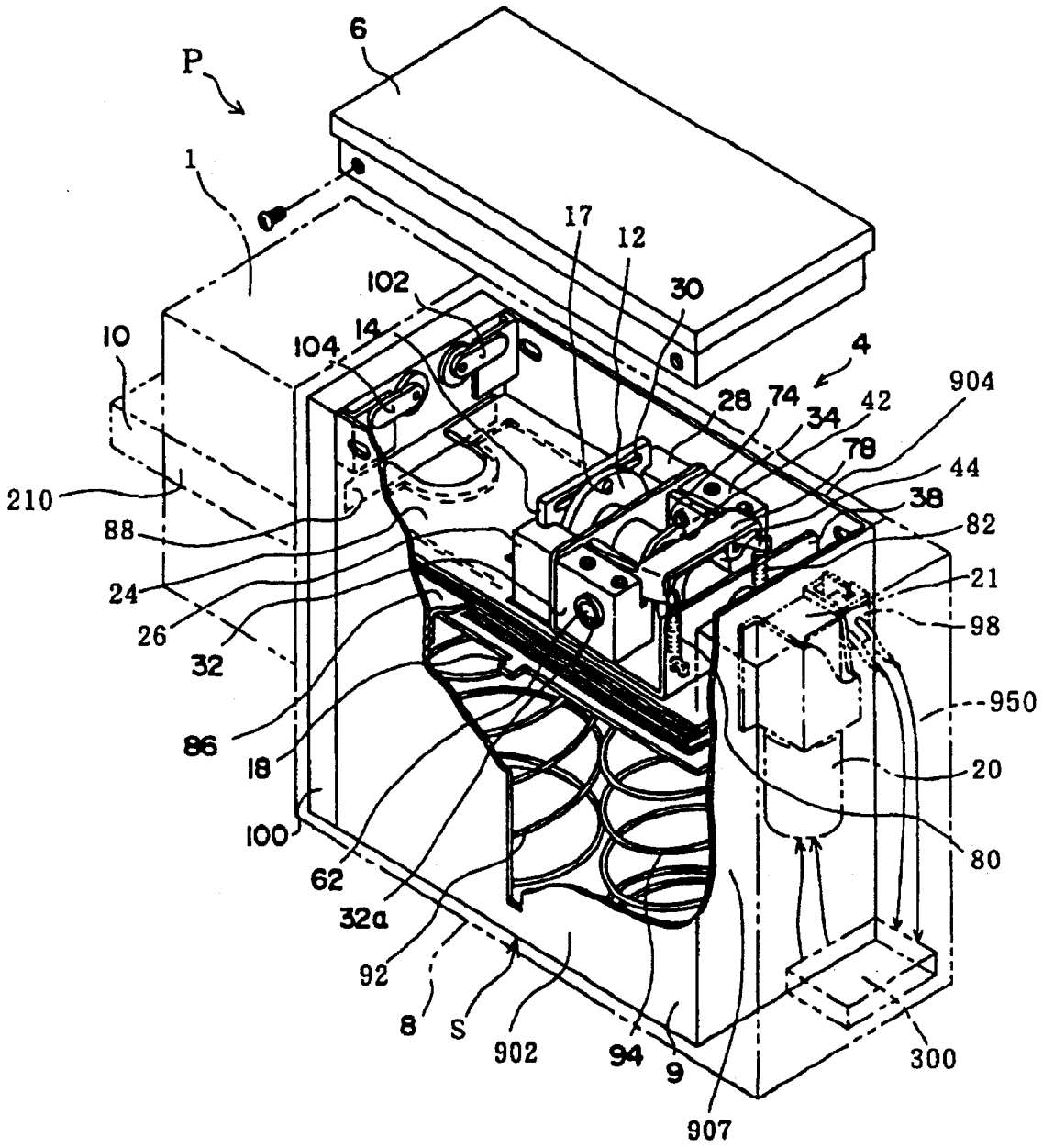
FIG. 2 is a perspective view of the paper currency acceptor with parts partially broken away.

Referring first to FIG. 1, there is shown a paper currency acceptor P according to the embodiment of the invention, which is comprised of a bill validator 1 for validating an individual sheet of paper currency (hereinafter referred to as "a bill"), a body block 8 receiving a paper currency storage unit (hereinafter referred to as "stacker") S for accumulating a large number of bills A in a manner stacked one upon another, and a drive source block 950. The stacker S is removably incorporated in the body block 8 of the paper currency acceptor P, and as shown in FIG. 2, is comprised of a door 100, a bill-displacing means block 4, a guide path 8G which forms a continuation of a conveyor block 210 disposed in the bill validator 1, and a bill-storing block 11 (see FIGS. 13 and 14).

The bill validator 1 verifies a bill A temporarily received via a receiving slot 10 as to its authenticity and value. The verification is executed by a control block 300 consisting of a CPU and a memory disposed in the bill validator 1. In other words, the CPU verifies the bill A as to its value by comparing preserved data of a validated bill with detection data of the bill A temporarily received. If the temporarily received bill A is validated, i.e. if it is determined the temporarily received bill A is acceptable, the bill A is transferred by the conveyor block 210 to the guide path 8G of the stacker S.

In addition, the bill validator 1 is attached to the body block 8 with shaft pins 3 inserted through a pair of holes formed in the left upper end of the body block 8, removably and rotatably as designated by arrow from the position as shown in FIG. 1. When the bill validator 1 is rotated clockwise in FIG. 1, the left side of the body block 8 is opened, therefore, the stacker S is removable from the body block 8.

Figure 13:
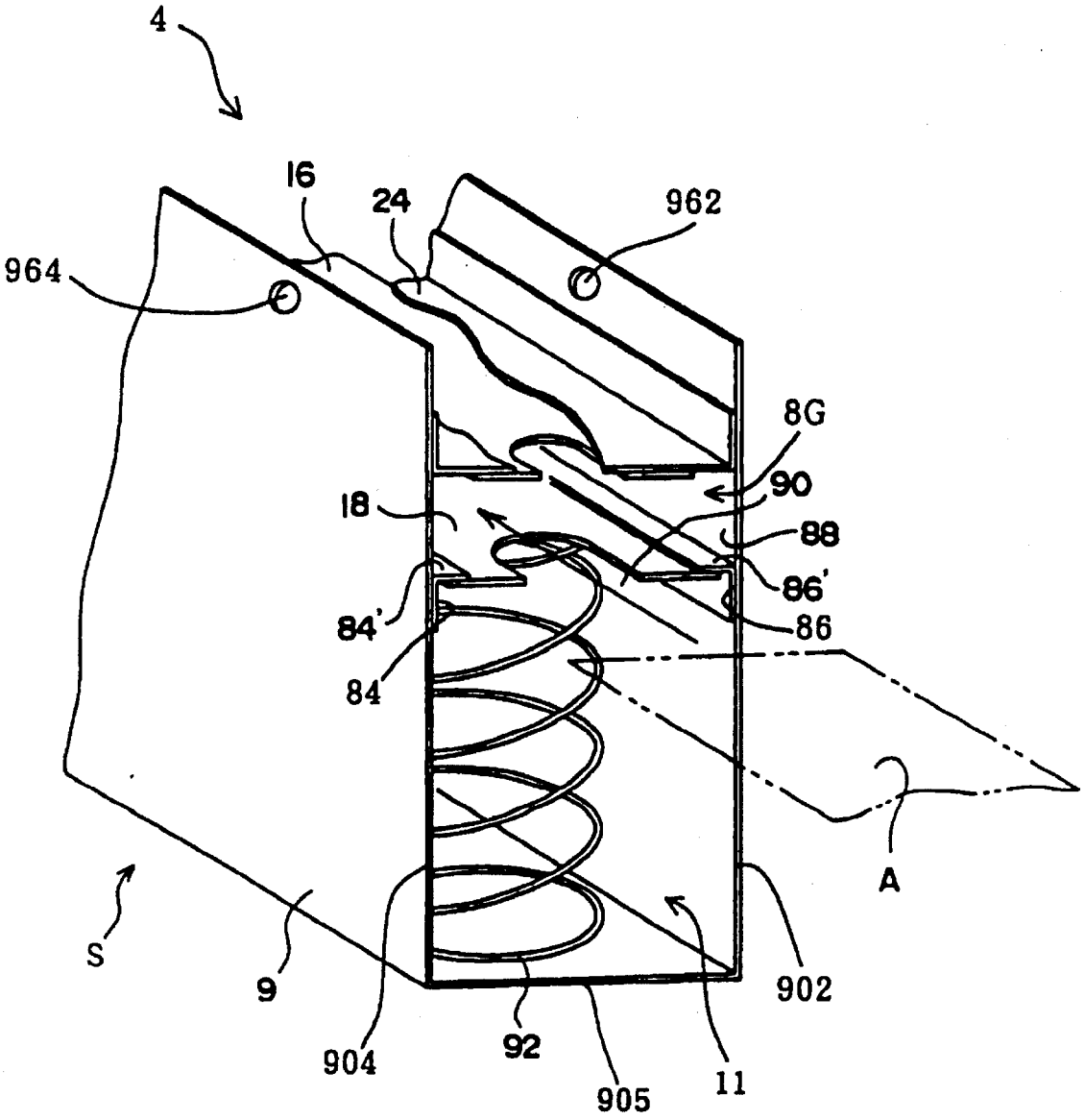
FIG. 13 is a view of the stacker in a state in which a bill is being received via a bill-accepting slot.
Figure 14:
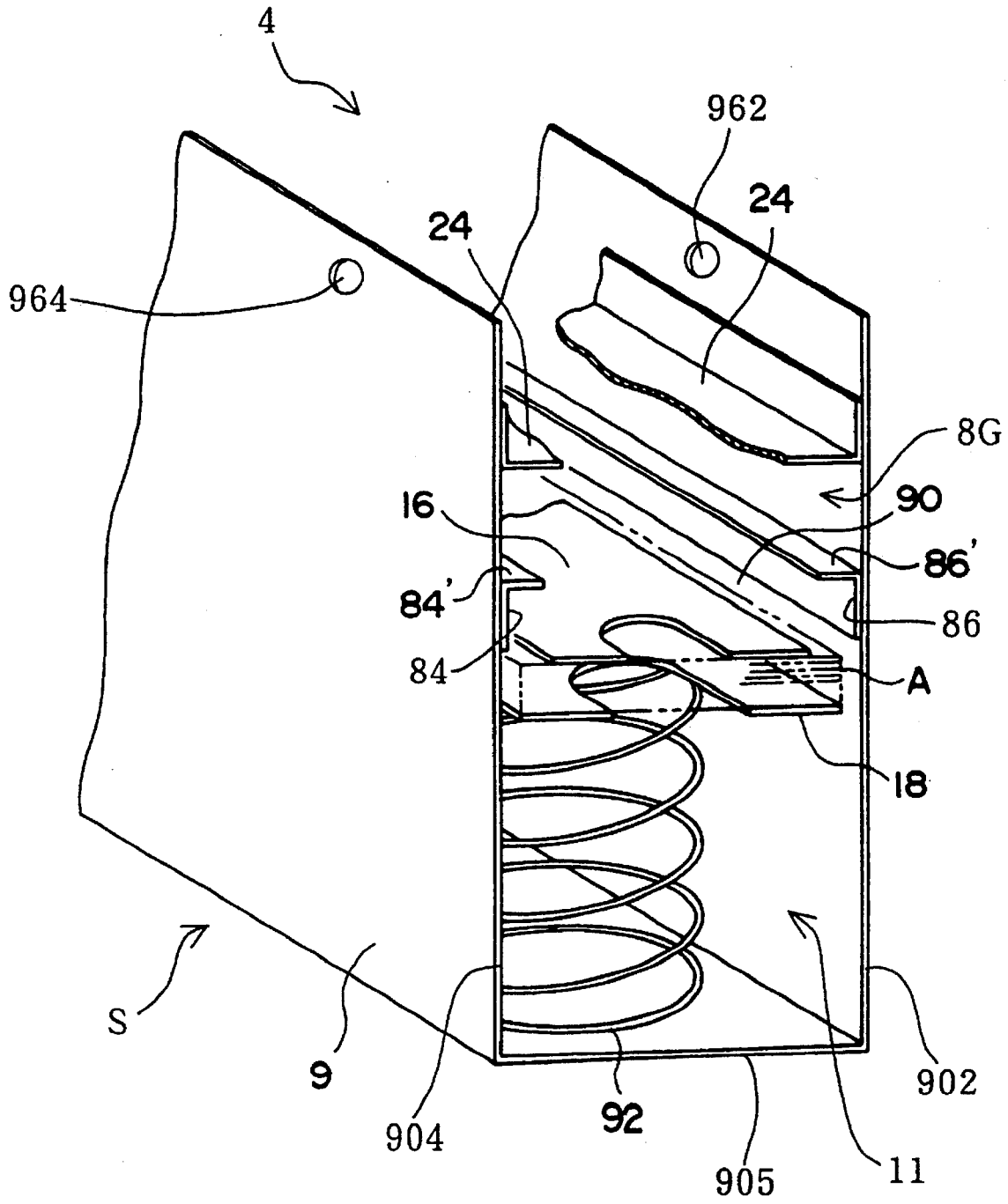
FIG. 14 is a view of the stacker in a state in which the received bill is pressed downward to its bottom position within the stacker.

As shown in FIGS. 13 and 14, the stacker S includes a housing 9 consisting of side walls 902, 904 formed with through holes 962, 964 through which rods 62, 64 are projected for locking, as described hereinafter, respectively, a rear wall 907 (see FIG. 2), and a bottom wall 905. The housing 9 is provided with a partition 24 secured to upper portions of inner wall surfaces of the side walls 902, 904, and inverted L-shaped members 84, 86 which have a pair of ledges 84', 86', and are secured to opposite portions of the inner wall surfaces of the side walls 902, 904 below the partition 24, respectively, whereby the stacker S is divided into the bill-displacing means block 4, the guide path 8G, and the bill-storing block 11.

The front side of the housing 9 facing toward the bill validator 1 is covered with the door 100, as will be described below. The door 100 is formed with a bill-accepting slot 88 through which the received bill is transferred from the conveyor block 210 to the guide path 8G of the stacker S (see FIGS. 2 and 4).

The bill-displacing means block 4 on the partition 24 has its open top, i.e. an open top of the housing 9, covered with a lid 6, which is fixed to the upper end of the housing 9 by screws.

The guide path 8G defined between the partition 24 and the ledges 84', 86' provides a temporary storage chamber where the bill A received via the bill accepting slot 88 (see FIGS. 2 and 4) is temporarily placed. The guide path 8G is formed at its bottom with an opening 90 defined between the ledges 84', 86' of the inverted L-shaped members 84, 86, through which the bill A is carried and displaced into the bill-storing block 11.

The opening 90 is usually blocked by a bill support platform 18, or a bill A or a stack of bills A retained on the bill support platform 18 in the bill-storing block 11. The bill support platform 18 is biased upward toward the ledges 84', 86' by a pair of coiled springs 92, 94 arranged on the bottom wall 905 of the housing 9 in a longitudinally spaced manner.

In the bill-displacing means block 4, an eccentric pin disc 12 and a slide plate 14, which form part of a vertical displacement mechanism, as will be described in detail hereinafter, co-operate to move a presser plate 16 (FIGS. 3 and 7) downward and upward. An electric motor 20 comprised in the drive source block 950 drives the vertical displacement mechanism to move the Dresser plate 16 downward for displacement of the bill A positioned under the presser plate 16. On this occasion, the bill A passes through the opening 90, which is smaller in width than that of the bill A, as shown in FIGS. 13 and 14 with longitudinal sides of the bill A deflecting against the ledges 84', 86', whereby the bill A is placed on the spring loaded bill support platform 18 within the bill-storing block 11. When the Dresser plate returns to its top position, the bill A is caught by the ledges 84', 86' and retained between the ledges 84', 86' and the bill support platform 18 urged upward by biasing force of the coiled springs 92, 94.

Thus, the presser plate 16 moves downward to its bottom position (see FIG. 3 and FIG. 14) to displace the bill A, and then returns to its top position (see FIG. 4 and FIG. 13), whereupon a plate 96 extending upward from a corner of the presser plate 16 is sensed by a photosensor 98. The photosensor 98 delivers a signal indicative of sensing of the plate 96 to the control block 300 comprised in the drive source block 950, and the control block 300 delivers a control signal to the electric motor 20 to inhibit the same from driving the vertical displacement mechanism.

In addition, as shown in FIG. 2, the control block 300 is disposed in the drive source block 950, however, the CPU in the bill validator 1 may be applied to the control block 300. In such case, the control block 300 is not located at the position as shown in FIG. 2, and the CPU is connected with the photosensor 98 and the electric motor 20 by electric wires.

The bill-accepting operation described above is repeatedly carried out whenever a new bill is inserted, whereby a plurality of bills A are stacked one upon another on the bill support platform 18 within the bill-storing block 11.

Figure 6:
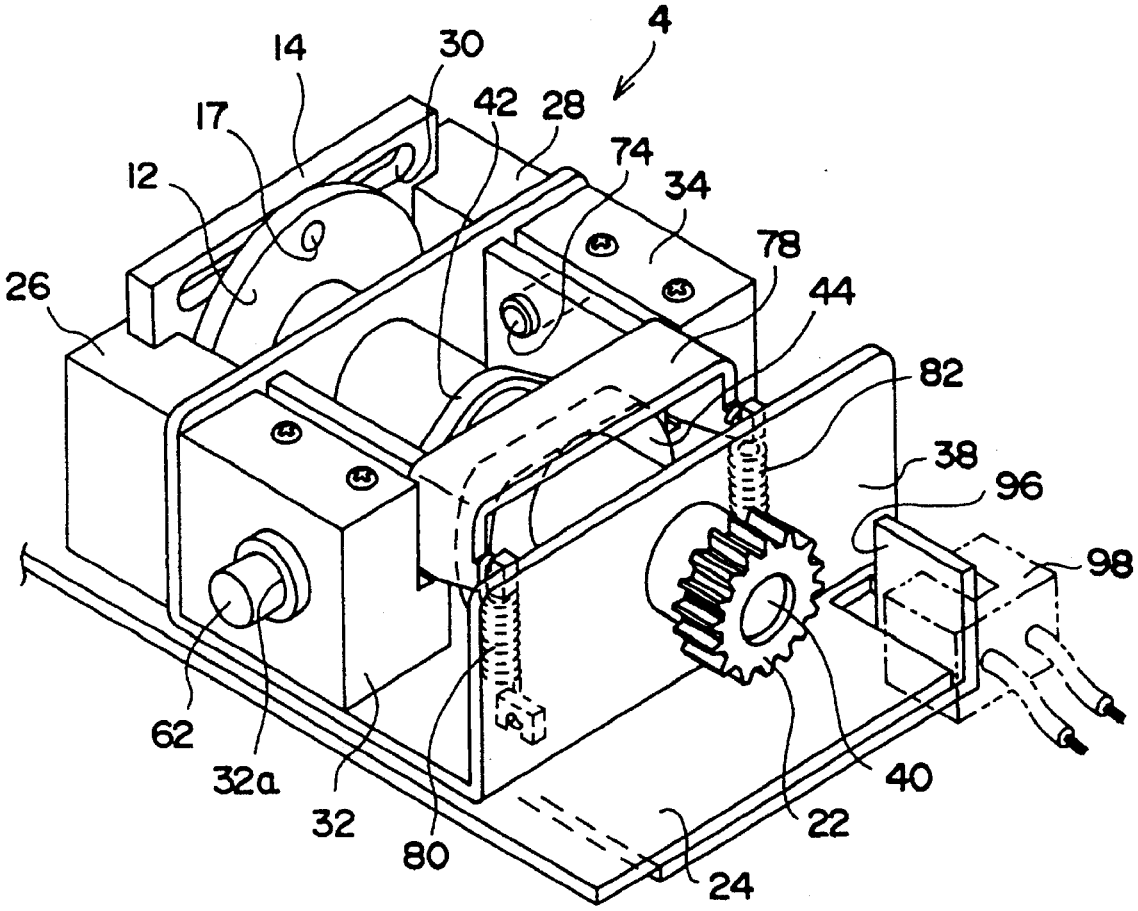
FIG. 6 is a perspective view of the locking/unlocking device accommodated within the bill-displacing means block appearing in FIG. 2, in its locking position.
Figure 7:
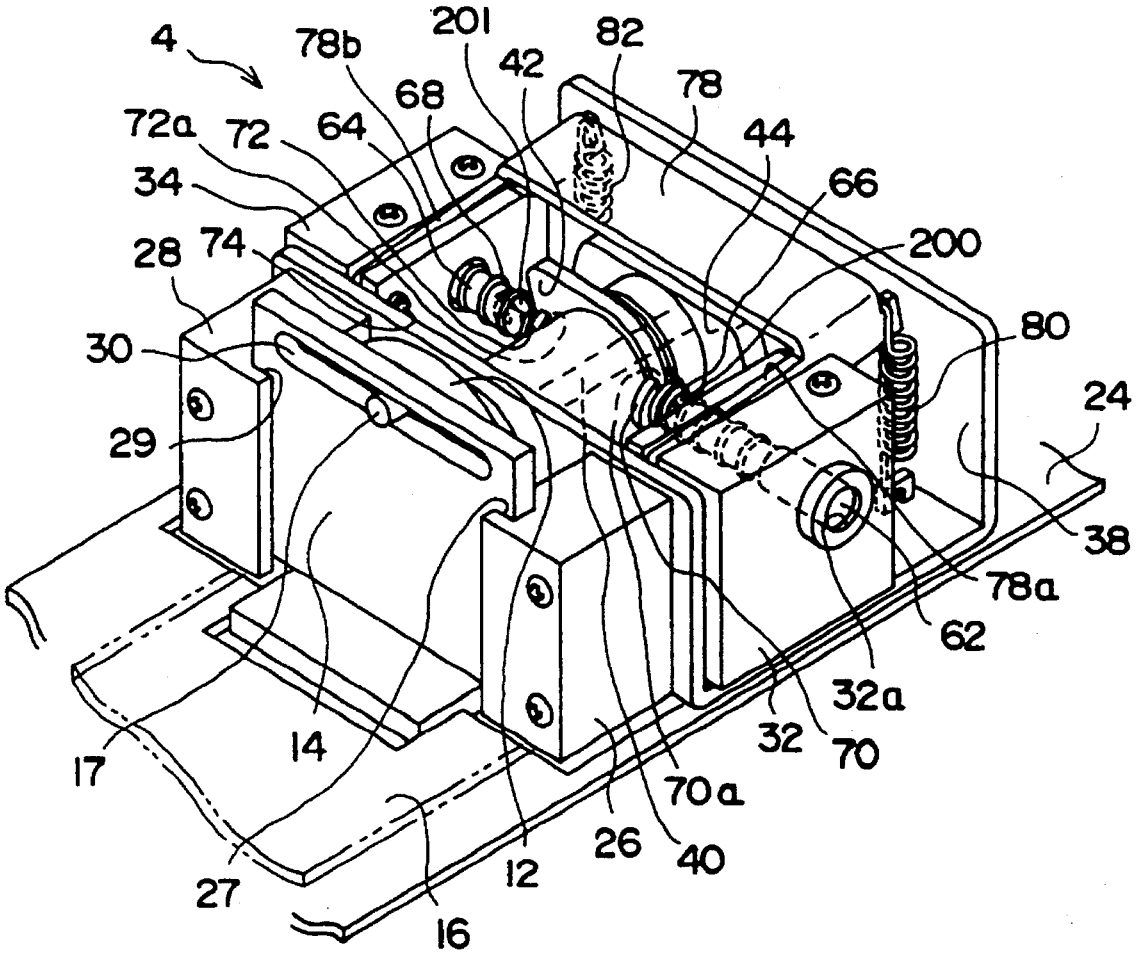
FIG. 7 is a perspective view of the locking/unlocking device appearing in FIG. 5 and FIG. 6, taken from a different point of view.

In the bill-displacing means block 4, as shown in FIG. 7, a U-shaped support plate 38 is mounted on the partition 24 of the housing 9. The opposing walls of the U-shaped support plate 38 each has a bearing, not shown, integrally formed in the center thereof for rotatively supporting a drive shaft 40 which extends through the support plate 38 in a longitudinal direction. A pair of cams 42, 44 are arranged around the drive shaft 40 via respective one-way clutches as will be described in detail hereinafter such that the cams 42, 44 are longitudinally spaced from each other by a predetermined interval, and as shown in FIGS. 3 to 6, the drive shaft 40 is integrally assembled with a splined shaft 22 at one end thereof facing toward the electric motor 20.

As shown in FIG. 2, the other end of the drive shaft 40 facing toward the bill validator 1 has the aforementioned eccentric pin disc 12 secured thereon. The eccentric pin disc 12 is formed with an eccentric pin 17 in the form of a cylinder projecting from a peripheral portion of the surface of the eccentric pin disc 12 facing toward the bill validator 1. The pin 17 is loosely or slidably fit in an elongated slot 30 extending transversely at an upper portion of a vertical part of the slide plate 14 having an L shape and secured to the top surface of the presser plate 16. The slide plate 14 has side edges of the vertical part thereof slidably fit in grooves 27, 29 formed in respective opposed inner surfaces of guide members 26, 28 arranged outside the support plate 38 and formed integrally therewith, whereby the slide plate 14 moves upward and downward while being guided by the grooves 27, 29 according to the rotation of the eccentric pin 12 which moves in unison with the drive shaft 40. Thus, the eccentric pin disc 12 with its eccentric pin 17, the slide plate 14 with its elongated slot 30, and the guide members 26, 27 with their grooves 27, 29 form the aforementioned vertical displacement mechanism. Since the slide plate 14 is integrally assembled with the presser plate 16, as the slide plate 14 moves upward and downward, the presser plate 16 moves upward and downward in unison therewith.

FIG. 7 shows the slide plate 14 held at its top position by the pin 17 of the eccentric pin disc 12. In this state, the top surface of the presser plate 16 (on the side remote from the bill A) abuts on the bottom surface or lower surface of the partition 24 of the housing 9.

The torque of the drive shaft 40 is transmitted to the cams 42, 44 via the one-way clutches for transmitting torque only in one direction.

Figure 11:
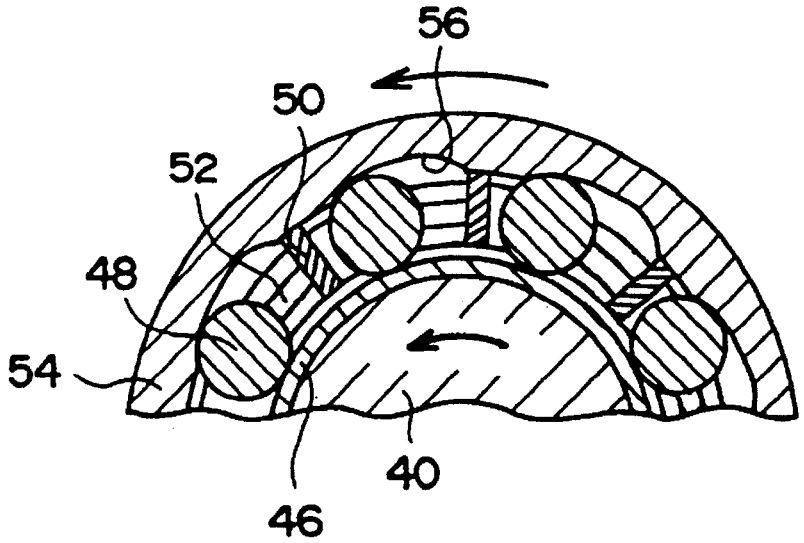
FIG. 11 is a cross-sectional view taken along lines XI—XI of FIG. 8, which shows a one-way clutch in a state in which a drive shaft is rotating in one direction.
Figure 12:
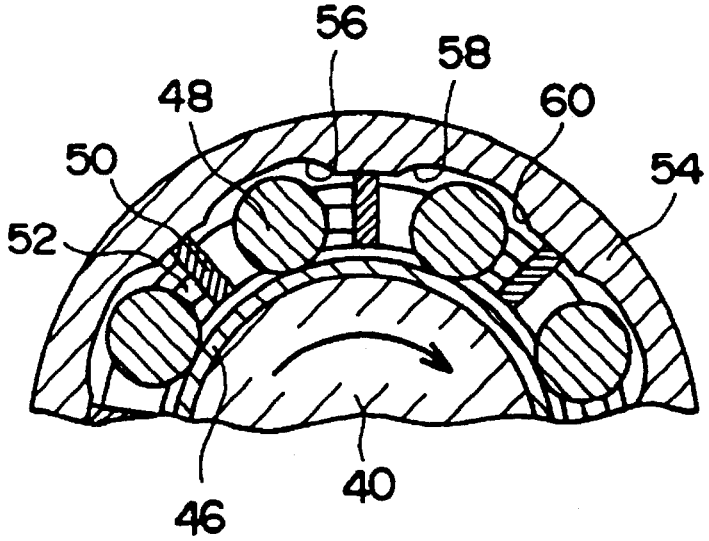
FIG. 12 is a cross-sectional view similar to that of FIG. 11, which shows the one-way clutch in a state in which the drive shaft is rotating in the other direction.

As shown in FIGS. 11 and 12, the one-way clutch has an inner ring 46 thereof in the form of a hollow cylinder rigidly fit on the drive shaft 40 for rotation in unison therewith. A plurality of needle rollers 48 are arranged between the inner ring 46 and an outer ring 54 in the form of a hollow cylinder, Retainers 50 which extend inward from the outer ring 54 are each provided between adjacent ones of the needle rollers 48. Further, a spring of coil or plate 52 is arranged between each retainer 50 and an associated one of the needle rollers 48, for biasing the needle roller 48 anticlockwise as viewed from these figures toward a shallow portion 58 of a cam surface 56 formed in the inner surface of the outer ring 54 for each of the needle rollers 48.

When the drive shaft 40 starts to rotate anticlockwise as designated by arrows in FIG. 11, the needle rollers 48 are urged anticlockwise by the torque transmitted by friction between the rollers and the inner ring 46 which rotates in unison with the drive shaft 40, whereby the needle roller 48 rolls toward the shallow portion 58 of the cam surface 56 formed in the inner surface of the outer ring 54, to be urged against the shallow portion 58 of the cam surface 56, serving as a wedge inserted between the inner ring 46 and the outer ring 54. Thus, the inner ring 46, the needle rollers 48, and the outer ring 54 cooperatively transmit the torque of the drive shaft 40 to the outer ring 54.

On the other hand. FIG. 12 shows a case in which the drive shaft 40 rotates clockwise (in the direction of the arrow therein). The inner ring 46 drives each off, the needle rollers 48 clockwise by the urging force generated by the rotation thereof but only to a position corresponding to a deep portion 60 of the cam surface 56 due to the biasing force of the plate spring 52 in the anticlockwise direction. In This state, the needle rollers 48 are in rolling contact with the inner ring 46, but not in substantial contact with the outer ring 54 and hence the torque of the drive shaft 40 is not transmitted to the outer ring 54.

Figure 8:
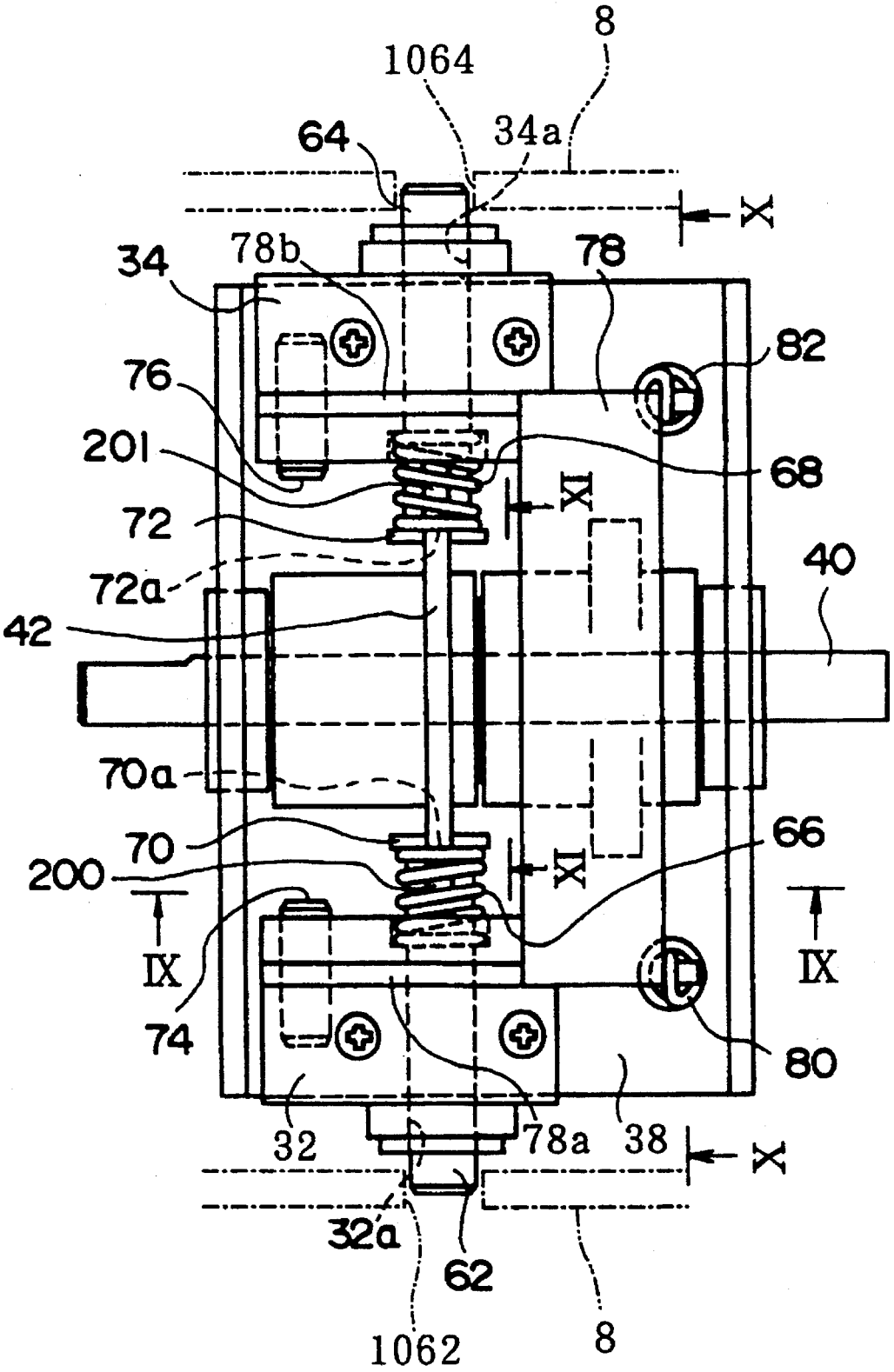
FIG. 8 is a top plan view of the locking/unlocking device.
Figure 9:
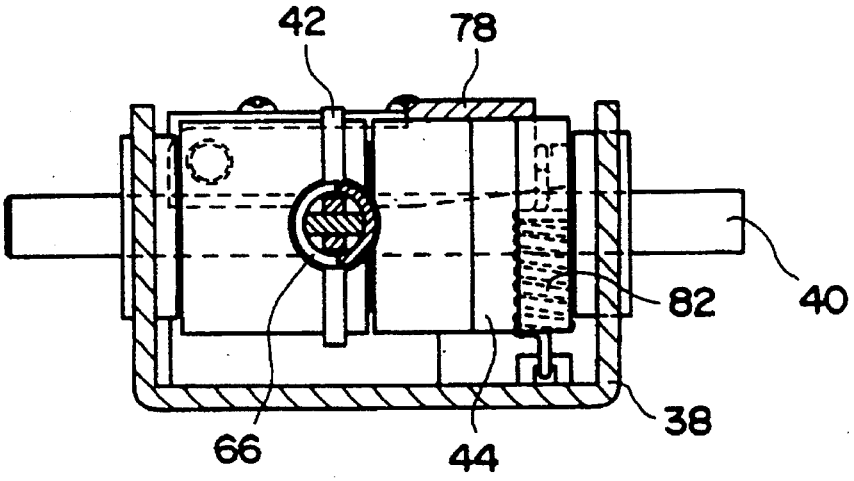
FIG. 9 is a cross-sectional view taken along lines IX—IX of FIG.
Figure 10:
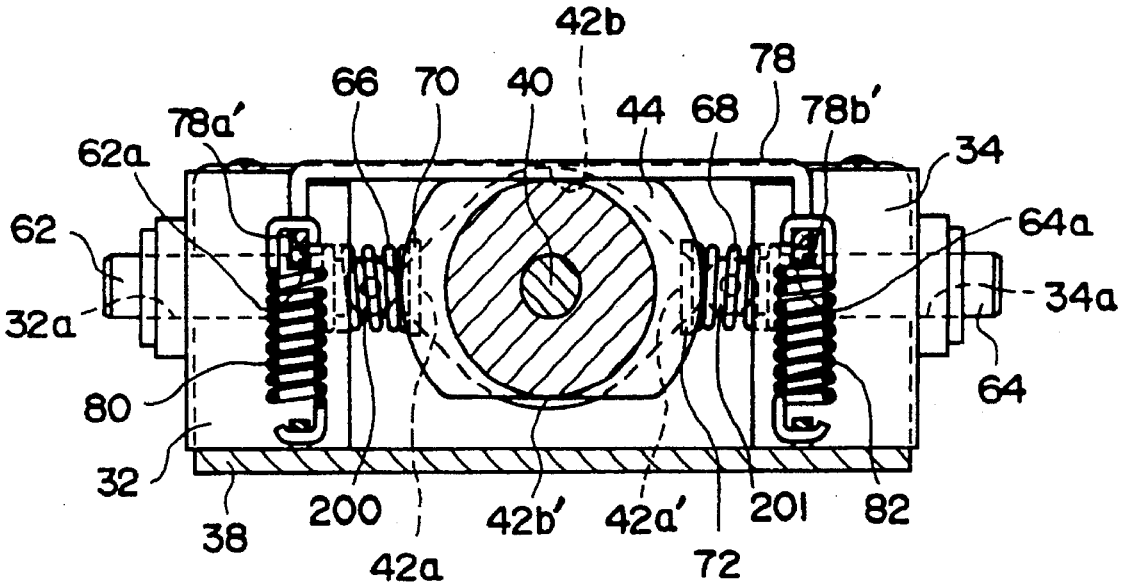
FIG. 10 is a cross-sectional view taken along lines X—X of FIG. 8.

Referring again to FIG. 7, support members 32, 34 in the form of a rectangular parallelepiped are symmetrically fixed to the inner bottom surface of the support plate 38 on opposite sides of the drive shaft 40. The support members 82, 34 are formed with through holes 32*a*, 34*a*, which extend through the center of the members 32, 34 in respective lateral directions to receive rods 62, 64 loosely therein. As shown in FIGS. 8 and 10, the rods 62, 64 are provided with cam catchers 70, 72 in the form of a flange at inner or drive shaft side ends thereof. The cam catchers 70, 72 are formed with grooves 70*a*, 72*a* in which slides the outer periphery of one of the aforementioned pair of cams (hereinafter referred to as "the first cam") 42. Coiled springs 66, 68 are fit on the rods 62, 64 between the cam catches 70, 72 and the support members 32, 34, respectively, thereby constantly biasing the rods 62, 64 toward the first cam 42 from the sides of the support plate The rods 62, 64 has rollers 200, 201 (FIG. 10) arranged in recesses formed in the bottom of the grooves 70*a*, 72*a* of the cam catchers 70, 72 so as to permit the outer periphery of the first cam 42 (having a projecting portion 42*a* and a portion 42*b*, described hereinafter) to smoothly slide in the grooves through rotation of the rollers 200, 201.

In the present embodiment, the support members 32, 34, the support plate 38, the drive shaft 40, the pair of cams 42, 44, the one-way clutches, the rods 62, 64, the coiled springs (compression springs) 66, 68, the cam catchers 70. 72, and the rollers 200, 201, as well as rotation shafts 74, 76, a cam-retaining plate 78, and coiled springs (extension springs) 80, 82, referred to hereinafter, constitute the locking/unlocking device.

According to the construction of the locking/unlocking device described above, as an output shaft, not shown, of the electric motor 20 rotates in the state shown in FIG. 2, an output shaft of a reduction gear 21 rotates, which has an input shaft thereof directly connected to the output shaft of the electric motor 20 and the output shaft thereof arranged crosswise to the input shaft. When the paper currency acceptor P is loaded with the stacker S, a splined shaft 23 formed with key ways (FIG. 15) is in engagement with keys formed around the splined shaft 22 provided at the one end of the drive shaft 40 positioned at the rear side of the bill-displacing block 4, whereby the torque is transmitted from the electric motor 20 to the drive shaft 40 to thereby rotate the drive shaft 40 in the direction of the arrows shown in FIG. 11. Since the aforementioned one-way clutch is interposed between the drive shaft 40 and the first cam 42, the inner ring 46 rotating in unison with the drive shaft 40 as shown in FIG. 11, in the present case, transmits the torque to the outer ring 54, which causes rotation of the first cam 42 integrally assembled therewith, thereby automatically performing locking operation. In this state, the inner ring of another one-way clutch having the same construction as that of the one-way clutch for the first cam 42 interposed between the other of the pair of the cams, i.e. the second cam 44 and the drive shaft 40 rotates with rotation of the drive shaft 40 as indicated by the arrow in FIG. 12, but the torque is not transmitted to the outer ring thereof, so that the second cam 44 does not rotate.

When the drive shaft 40 rotates anticlockwise, i.e. in the direction of the arrows in FIG. 11, the torque transmitted to the outer ring 54 causes rotation of the first cam 42. Accordingly, the first cam 42 rotates with the outer periphery thereof sliding on the rollers 200, 201 in the grooves 70*a*, 72*a* of the cam catches 70, 72 provided at the inner or drive shaft side ends of the rods 62, 64, thereby laterally or outwardly urging the rods 62, 64. The rods 62, 64 are moved outward to respective projecting positions.

When the body block 8 of the paper currency acceptor P is loaded with the stacker S as shown in FIG. 1, the rods 62, 64 are projected out of the side walls 902, 904 of the housing 9 via the through holes 962, 964 thereof to be engaged in respective corresponding engaging holes 1062, 1064 formed in predetermined positions of the body block 8 as shown in FIG. 8, whereupon lower edges 78*a*', 78*b*' (FIG. 10) of two arms 78*a*, 78*b* of the cam-retaining plate 78, which extend along the drive shaft 40, are caused to be engaged in grooves 62*a*, 64*a* formed in the upper surfaces of the rods 62, 64 by the pulling force of the extension springs 80, 82 stretched between the cam-retaining plate 78 and the bottom of the support plate 38, whereby the rods 62, 64 are retained in the projecting positions. In this state, the positions of the rods 62, 64 are no longer dependent on the torque of the first cam 42, which permits the drive shaft 40 to freely rotate with the rods 62, 64 being projected outward of the support members 32, 34. Accordingly, the presser plate 16 can be moved upward to its top position where it abuts on the bottom surface of the separator 24.

Figure 4:
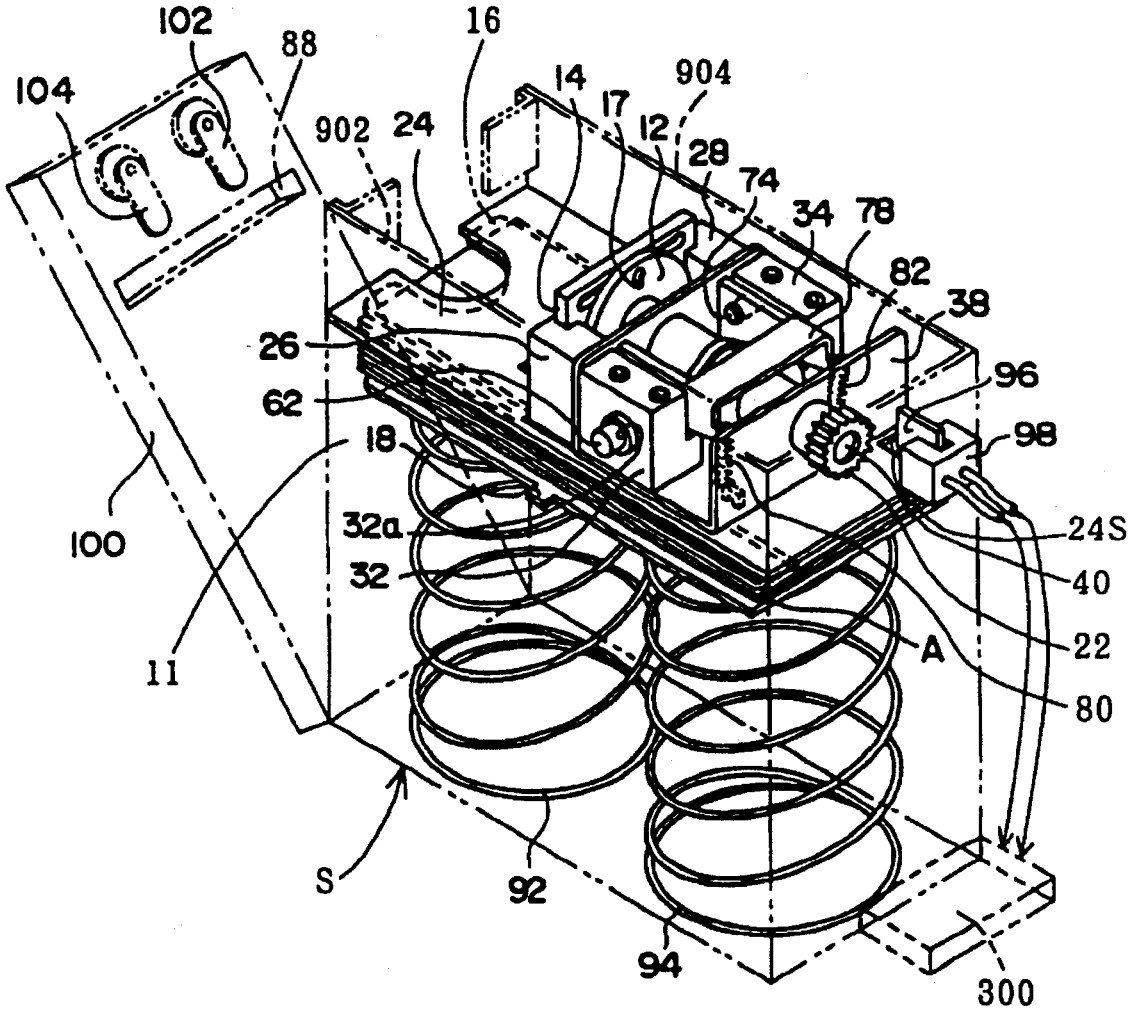
FIG. 4 is a perspective view of the interior of the stacker removable from the FIG. 2 paper currency acceptor in a state in which the presser plate thereof has reached its top position.

In this state in which the open ends of the rods 62, 64 extending through the support plates 32, 34 (FIGS. 4 and 6)

are projected outward of the side walls 902, 904, the stacker S loaded in the paper currency acceptor P is locked. That is, the operator cannot remove the stacker S from the other part of the paper currency acceptor P. On the other hand, as shown in FIGS. 2, 3, 5 and 7, when the rods 62, 64 are not projected outward of the side walls 902, 904, the stacker S is unlocked, and the operator can remove the stacker S from the body block 8. In addition, the stacker S may be constructed such that it is received within a housing rigidly fixed in a slot machine, and the housing is provided with holes in which the rods 62, 64 may be caused to be engaged.

Next, the other of the pair of cams provided around the drive shaft 40, i.e. the second cam 44, abuts on the bottom surface of a transversely-extending main part of the cam-retaining plate 78, which is positioned above the drive shaft 40. As shown in FIG. 6, the cam-retaining plate 78 is U-shaped when viewed from the above, with its arms 78*a*, 78*b* extending along the sides of the drive shaft 40. The arms 78*a*, 78*b* are rotatively supported by the rotational shafts 74, 76 journalled for rotation in the aforementioned pair of support members 32, 34, and the extension springs 80, 82 stretched between portions of the cam-retaining plate on the side remote from the arms 78*a*, 78*b* and hooks provided on the upper surface of the bottom of the support plate 38, respectively, pull the cam-retaining plate 78 downward to hold the second cam 44 to its level position.

To actuate the locking/unlocking device for unlocking operation, i.e. to cause the rods 62, 64 to retract from their projecting positions, it is only required to drive the electric motor 20 for rotation of the drive shaft 40 in an opposite direction to that for the locking operation described above, i.e. in the direction of the arrow in FIG. 12, to thereby cause the second cam 44 to swing upward to disengage the arms 78*a*, 78*b* thereof from the grooves 62*a*, 64*a* of the rods 62, 64.

The second cam 44 is provided on the drive shaft 40 by way of the one-way clutch as well, as described above. When the second cam 44 is rotated in the direction opposite to that for the locking operation, the eccentric pin disc 12 is rotated in a direction opposite to the direction taken when the first cam 42 is rotated.

When the pin 17 of the eccentric pin disc 12 is at its top position, the slide plate 14 is elevated to its top position, and the presser plate 16 abuts on the bottom surface of the partition 24. In this state, the bill A inserted via the receiving slot 10 shown in FIG. 2, if validated by the bill validator 1, is transferred therefrom via the bill-accepting slot 88 of the door 100 into the guide path 8G. In this state, the bill A is located on the ledges 84, 86 and the bill support platform 18 or the top sheet of bills accumulated on the platform 18, which blocks off the opening 90 formed between the ledges 84, 86.

Now, the relationship of the first cam 42 and the second cam 44 will be described in more detail.

As described above, the one-way clutch provided between the first cam 42 and the drive shaft 40 causes the first cam 42 to rotate in unison with the drive shaft 40 in an opposite direction to the direction of rotation of the second cam 44 which is to be supplied with torque from the drive shaft 40 via the one-way clutch provided between itself and the drive shaft 40. In the state of stacker S being loaded in the paper currency acceptor P, the stacker S is locked so long as the first cam 42 has pushed the rods 62, 64 outward to their projecting positions shown in FIG. 6, in which they extend through the through holes 32*a*, 34*a* of the support members 32, 34 and the corresponding through holes 962, 964 formed in the side walls 902, 904 of the housing 9 to be inserted into the engaging holes 1062, 1064 provided in the body block 8. That is, the second cam 44 permits the cam-retaining plate 78 to move downward by the pulling force of the extension springs 80, 82 to cause the edges 78*a*', 78*b*' of the arms 78*a*, 78*b* thereof to be engaged in the grooves 62*a*, 64*a* of the rods 62, 64 (FIG. 10), thereby preventing the rods 62, 64 from retracting. In short, the stacker S is prevented from being unlocked by the cam-retaining plate 78.

Figure 5:
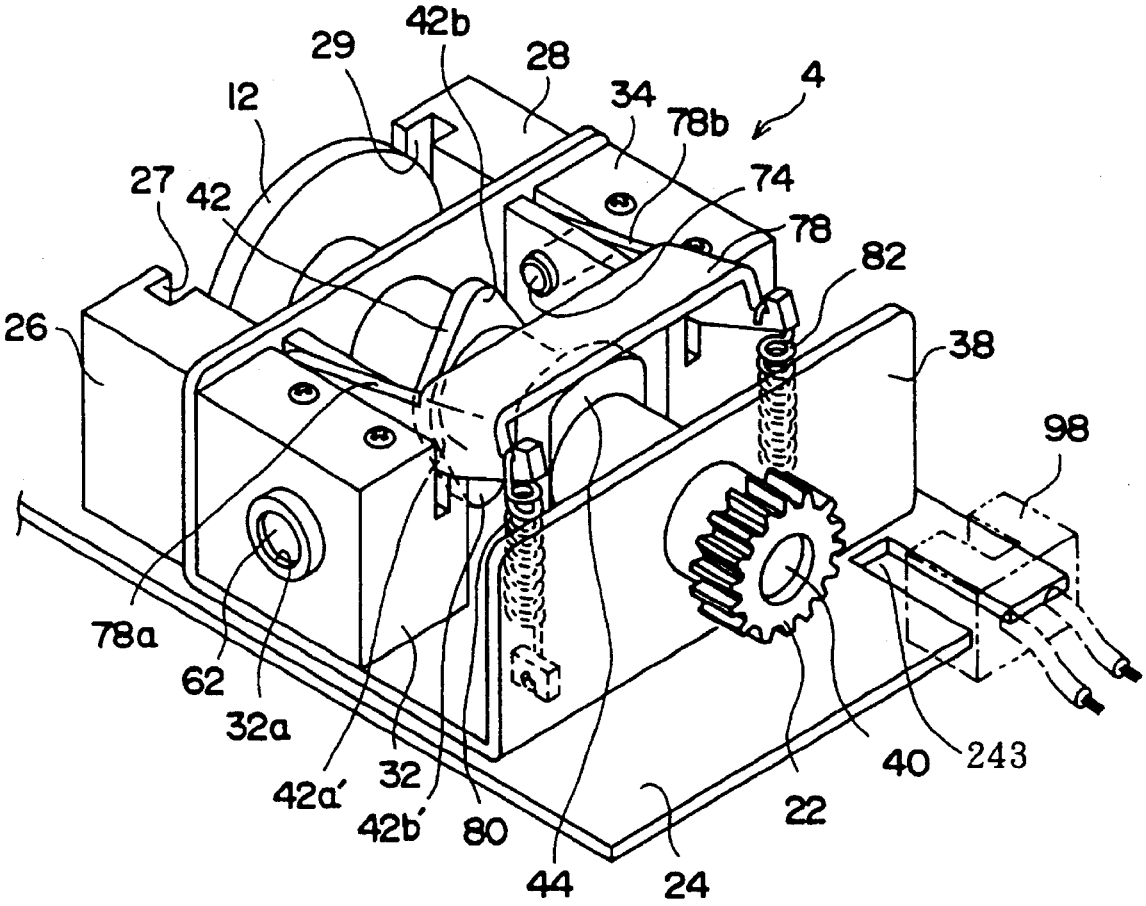
FIG. 5 is a perspective view of a locking/unlocking device accommodated within a bill-displacing means block appearing in FIG. 2, in its unlocking position.

On the other hand, as shown in FIG. 5, when the rods 62, 64 are not projected outward of the side walls 902, 904, the stacker S is unlocked.

To unlock the stacker S in the locked state shown in FIG. 6 to its state shown in FIG. 5, the locking/unlocking device operates in the following manner: In FIG. 6, the drive shaft 40 is rotated in such a direction that the one-way clutch transmits the torque of the drive shaft to the second cam 44. The second cam 44 rotates accordingly to lift the cam-retaining plate 78 to have its arms 78*a*, 78*b* disengaged from the rods 62, 64. On the other hand, the torque is not transmitted from the drive shaft 40 to the first cam 42, but the coiled springs 66, 68 urge the rods 62, 64 inward, i.e. toward the drive shaft 40, so that the first cam 42 rotates in the direction that the torque thereof is not transmitted to the drive shaft 40 by sliding on the rollers 200, 201 rolling at the bottom of the cam catchers 70, 72, whereby the first cam 42 is shifted from a position (FIG. 10) in which the projecting portions 42*a*, 42*a*' of the first cam 42 with a large curvature are in the cam catchers 70, 72 to a position (FIG. 5) in which the portions 42*b*, 42*b*' of the same with a smaller curvature are in the cam catchers 70, 72, respectively, and stops thereat. In this state, the stacker S is unlocked as shown in FIG. 5, i.e. it can be loaded into the body block 8 or removed therefrom.

Figure 15:
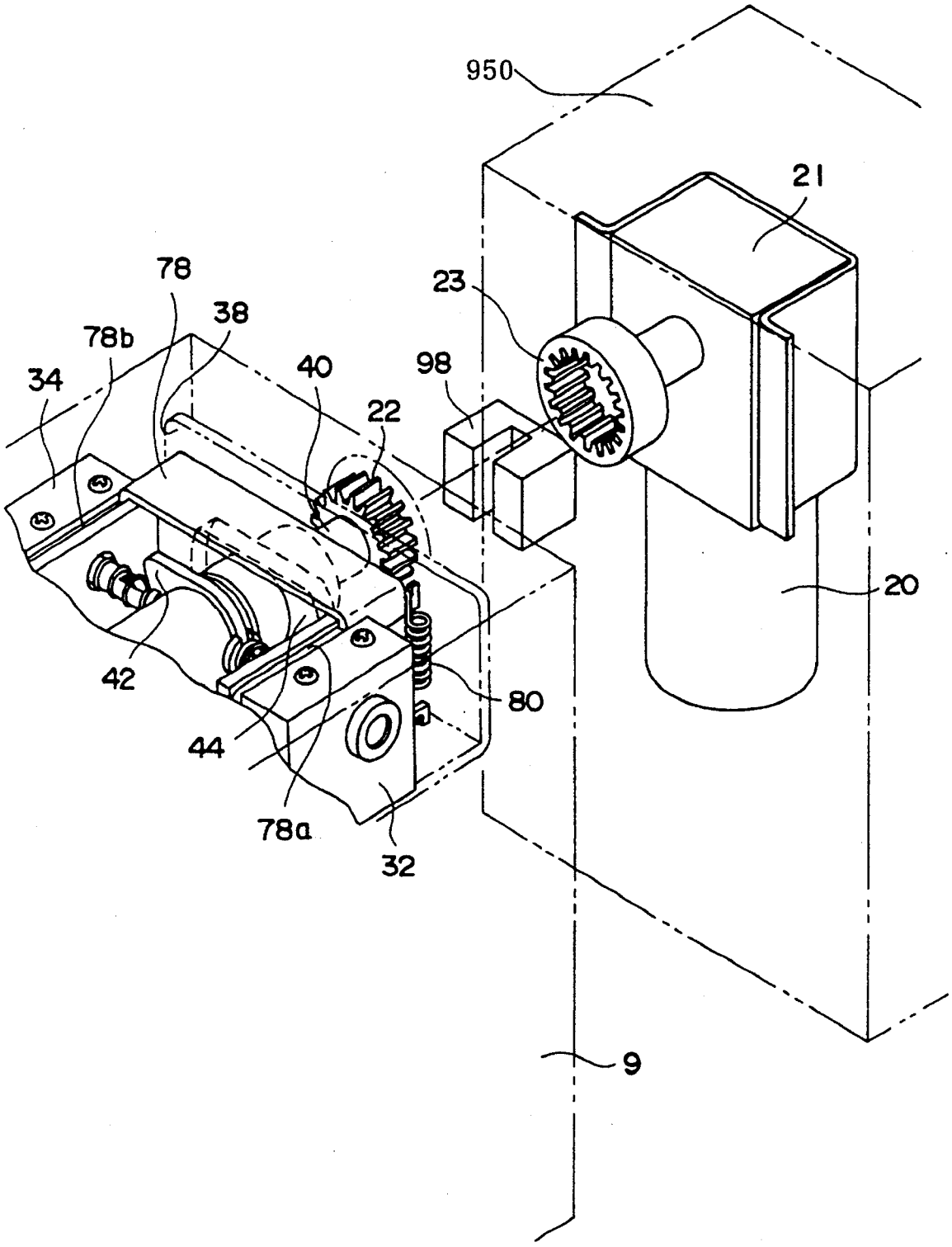
FIG. 15 is a view showing the relationship between a couple of splined shafts associated with each other for transmitting torque from an electric motor to the bill-displacing means.

Next, when the stacker S is loaded into the body block 8, the splined shaft 22 at the one end of the drive shaft 40 is in mating connection with the splined shaft 23 of the output shaft of the reduction gear 21 (FIG. 15). At this time, the presser plate 16 is in its top position and the plate 96 which extends upright from the corner of the pressure plate 16 is projected outward or upward of the partition 24 via a slot 24S (FIG. 4) formed therein. Therefore, in loading of the stacker S, the photosensor 98 detects the plate 96 which is inserted therein, and delivers a signal indicative of sensing of the plate to the control block 300 or the CPU in the bill validator 1 (hereinafter referred to as "the control block 300") initially after the stacker S is loaded. The control block 300, which is responsive to the signal generated upon loading of the stacker S, delivers a drive start signal to the electric motor 20 to cause the drive shaft 40 to rotate in the locking direction via the reduction gear 21. This automatically places the stacker S into its locked state shown in FIG. 4 and FIG. 6.

In unlocking the stacker S, an unlocking drive signal is delivered from the control block 300 to the electric motor 20. The electric motor 20 causes the drive shaft 40 to rotate in the direction opposite to that for locking the stacker S, whereby the second cam 44 moves the cam-retaining plate 78 upward to disengage the edges of 78*a*', 78*b*' from the grooves 62*a*, 64*a*. This permits the rods 62, 64 to move to their retracted position in which they no longer project through the holes of the side walls 902, 904 of the housing 9, thereby unlocking the stacker S.

In addition, the control block 300 also delivers a signal for driving the electric motor 20 to actuate the vertical displacement mechanism described hereinbefore.

The unlocking operation of the locking/unlocking device is performed when the control block 800 responsive to a predetermined unlocking control signal drives the electric motor 20 in the unlocking direction. The predetermined unlocking control signal is (1) generated when conditions of the unlocking operation are fulfilled ,e.g. when the front door of the slot machine containing the paper currency acceptor P is opened, or (2) delivered from a control system for controlling slot machines to the control block 300 as desired.

More specifically, the conditions of the unlocking operation are satisfied, for example:

1. When the operator unlocks and opens the front door, not shown, of a gaming machine which contains the paper currency acceptor according to the present embodiment. This unlocking operation is carried out in the following manner, and detected by detecting means, such as a door switch:

(1) The operator opens the front door by an exclusive key. Or alternatively, (2) The operator opens the front door by an exclusive card (an IC card, a magnetic card, or the like). In this case, an inserting slot may be provided on the front door exclusively for the card, or the receiving slot 10 may be commonly used for the inserting slot of the card (FIG. 2). Information recorded on the card, such as a password, is read by a reader, and sent to the control block 800.

2. When an additional predetermined unlocking operation is carried out by inserting a predetermined key into a key hole, not shown, provided in the interior of the gaming machine which has been opened, in addition to the operations for unlocking and opening the front door of the gaming machine described in 1.
3. When an additional predetermined unlocking operation is carried out by means of a card (an IC card, a magnetic card, or the like) for unlocking the stacker S, in addition to the operations for unlocking and opening the front door of the gaming machine described in 1.
4. When the operator is identified by an ID card (an IC card, a magnetic card, or the like), before unlocking and opening the front door as described above.

The reason for prescribing the above procedure for unlocking the stacker S is that it is preferred for the purpose of prevention of crime and management of money or bills that a maintenance man for gaming machines, a collector for collecting stackers S, and a clerk for taking out bills A from the stackers S collected for bill collection, each have different exclusive keys or cards, respectively.

According to the above embodiment, the locking/unlocking device is provided on an intermediate portion of the drive shaft 40 driven by the electric motor 20 for actuating the vertical displacement mechanism. Therefore, it is possible to automatically lock the stacker S to the paper currency acceptor P and unlock the former from the latter without necessitating additional space for the locking/unlocking device.

Further, since the stacker does not contain the electric motor 20, the stacker S is light in weight, and it is possible to reduce the labor of collectors for collecting stackers S. Further, since the means for transmitting torque of the electric motor 20 to the drive shaft 40 within the stacker S is constituted by the splined shaft 22 and the electric motor side splined shaft 23 for removable engagement with the splined shaft 22, it is easy to remove the stacker S from the body block 8 of the paper currency acceptor P because of little resistance encountered in the removing operation.

Further, when the first cam 42 actuates the rods 62, 64 in the locking direction, the outer periphery thereof slides on the rollers 200, 201, which minimizes load on the electric motor 20 when it is driven, while providing smooth rotation of the drive shaft 40. This makes it possible to employ a small electric motor.

Figure 3:
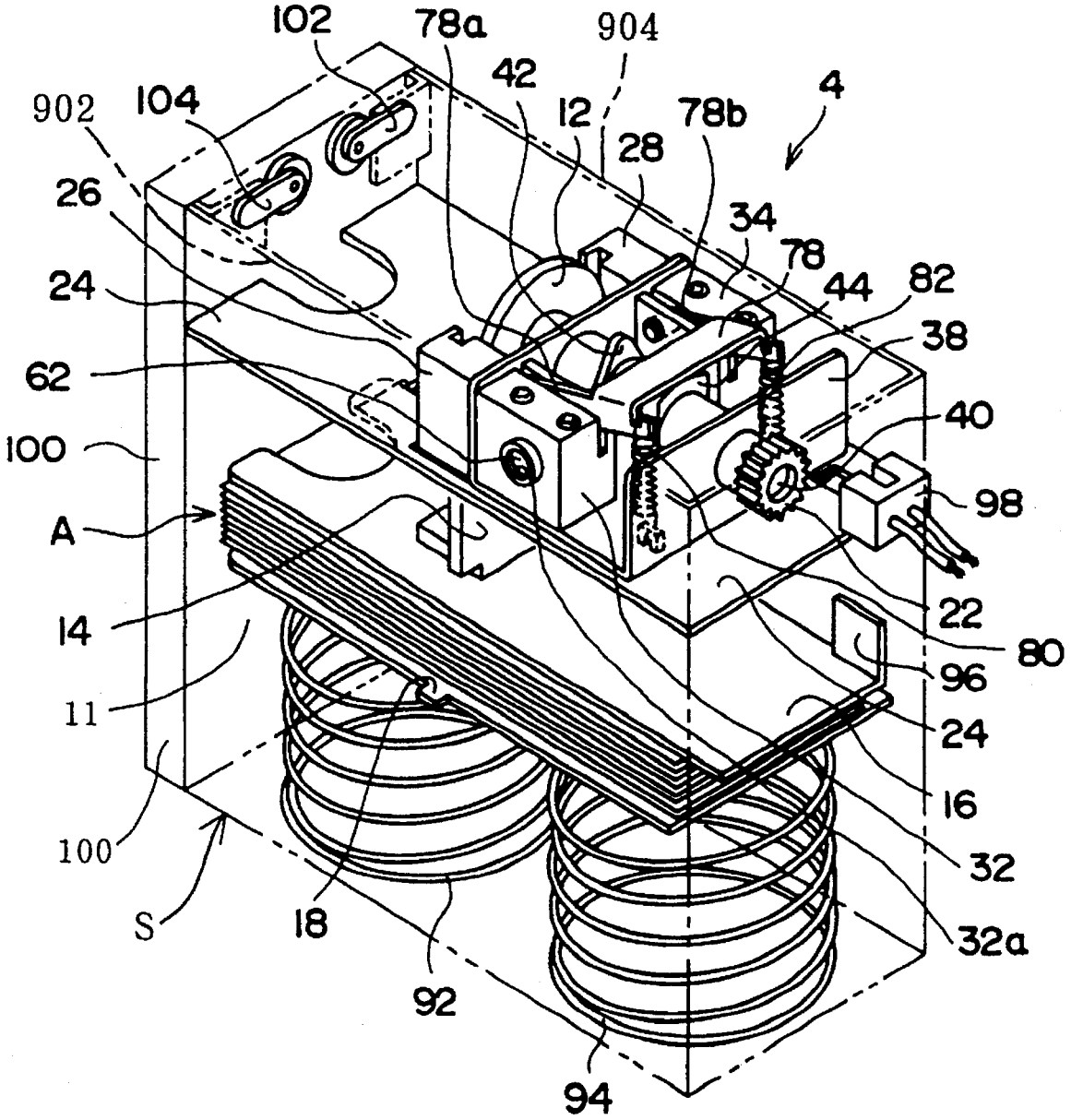
FIG. 3 is a perspective view of the interior of a stacker removable from the FIG. 2 paper currency acceptor in a state in which a presser plate thereof has pressed bills downward.

Finally, the bills stored in the stacker S can be removed therefrom by opening the door 100 removably mounted on the front opening of the housing 9 as shown in FIGS. 2 to 4. The door 100 is equipped with a key mechanism for proper opening operation.

FIGS. 2 and 3 show a case in which the door is closed and fixed to the housing 9 by means of locking plates 102, 104, while FIG. 4 shows a case in which the door 100 is opened by rotating the locking plates 102, 104 to disengage the same from the housing 9 by means of a key therefor from the front side of the door 100. Therefore, in removing the bills from the stackers S collected, the key is inserted into the key hole, not shown, for rotating the locking plates 102, 104 from positions shown in FIG. 2 and FIG. 3 to positions shown in FIG. 4, thereby disengaging the door 100 from the housing 9, and then the door 100 is opened.

Having described our invention as related to the embodiment shown in the accompanying drawings, it is our intention that the invention is not limited by any of details of description, unless otherwise specified, but rather be constructed broadly within its spirit and scope as set out in the accompanying claims for attaining the object of the object. Further, although the paper currency acceptor of the embodiment is applied to the slot machine, this is not limitative, but it may be applied to other gaming machines, vending machines, etc.

What is claimed is:

1. In a paper currency acceptor for receiving paper currency and storing said paper currency therein, including:

paper currency-validating means for verifying validity of paper currency temporarily received from the outside of said paper currency acceptor to validate or reject said temporarily received paper currency;

a paper currency storage means removable from said paper currency acceptor for storing said paper currency validated by said paper currency-validating means;

conveyor means for transferring said paper currency to said paper currency storage means;

paper currency-displacing means for displacing said paper currency transferred from said conveyor means into said paper currency storage means for storage therein;

a drive source for driving said paper currency-displacing means; and locking/unlocking means for locking said paper currency storage means to make it impossible to remove said paper currency storage means from said paper currency acceptor, the improvement wherein said drive source is provided separately from said paper currency storage means, and said locking/unlocking means is driven by said drive source for locking and unlocking operations thereof.

2. A paper currency acceptor according to claim 1, wherein said locking/unlocking means is arranged between said drive source and said paper currency-displacing means.

3. A paper currency acceptor according to claim 2, wherein said locking/unlocking means comprises a drive shaft driven by said drive source for rotation to transmit driving force from said drive source to said paper currency-displacing means, a pair of cams arranged on said drive shaft, and one-way clutches interposed between one of said pair of cams and said drive shaft and between the other of said pair of cams and said drive shaft, respectively, with one of said one-way clutches for one of said pair of cams and the other of said one-way clutches for the other of said pair of cams being opposite in the direction of rotation in unison with said drive shaft for transmitting said driving force.

4. A paper currency acceptor according to claim 8, wherein said locking/unlocking means includes a pair of rods which are capable of being displaced in opposite directions according to the rotation of one of said pair of cams, and wherein when said drive shaft is driven by said drive source for rotation in a locking direction, said pair of rods are actuated outward by said one of said pair of cams so as to be retained in respective locking positions in which said pair of rods are projected out of said paper currency acceptor.

5. A paper currency acceptor according to claim 4, wherein said pair of rods have grooves for engagement with retaining means for retaining said rods in said respective locking positions, and wherein said retaining means is disengaged from said grooves according to rotation of the other of said pair of cams.

6. A paper currency acceptor according to claim 8, wherein said paper currency storage means, said paper currency-displacing means, and said locking/unlocking means are arranged in one housing to form a unit removable from said paper currency acceptor.

7. A paper currency acceptor according to claim 4, wherein said paper currency storage means, said paper currency-displacing means, and said locking/unlocking means are arranged in one housing to form a unit removable from said paper currency acceptor.

8. A paper currency acceptor according to claim 7, wherein said rods are projected out of said housing when they are in said locking positions.

9. A paper currency acceptor according to claim 1, including control means for delivering a locking drive signal to said drive source to thereby cause said locking/unlocking means to be driven in said locking direction.

10. A paper currency acceptor according to claim 9, including a detector for detecting loading of said paper currency storage means when said paper currency storage means is loaded in said paper currency acceptor, and delivering a signal indicative of detection of said loading of said paper currency storage means to said control means, wherein said control means delivers said locking drive signal to said drive source in response to said signal from said detector.

11. A paper currency acceptor according to claim 9, wherein said control means delivers an unlocking drive signal to said drive source in response to a predetermined unlocking operation signal, to thereby cause said locking/unlocking means to be driven in an unlocking direction.

12. A paper currency acceptor according to claim 10, wherein said control means delivers an unlocking drive signal to said drive source in response to a predetermined unlocking operation signal, to thereby cause said locking/unlocking means to be driven in an unlocking direction.

* * * * *

UNITED STATES PATENT AND TRADEMARK OFFICE

CERTIFICATE OF CORRECTION

PATENT NO. : 5,564,545

DATED : October 15, 1996

INVENTOR(S) : Yasuo Suzuki

It is certified that error appears in the above-indentified patent and that said Letters Patent is hereby corrected as shown below:

Col. 4, line 30, after "FIG." insert -- 8 --;

Col. 5, line 64, change "Dresser" to -- presser --;

Col. 6, line 5, change "Dresser" to -- presser -- and after "plate" insert -- 16 --;

Col. 7, line 13, change "," to -- . --;

Col. 7, line 39, change "This" to -- this --;

Col. 7, line 49, change "82" to -- 32 --;

UNITED STATES PATENT AND TRADEMARK OFFICE

CERTIFICATE OF CORRECTION

PATENT NO. : 5,564,545

DATED : October 15, 1996

INVENTOR(S) : Yasuo Suzuki

It is certified that error appears in the above-indentified patent and that said Letters Patent is hereby corrected as shown below:

Col. 11, line 2, change "800" to -- 300 --;

Col. 11, line 6, change "fulfilled ,e.g." to -- fulfilled, e.g. --;

Col. 11, line 28, change "800" to -- 300 --;

Claim 4, line 1 change "8" to -- 3 --; and

Claim 6, line 1, change "8" to -- 3 --.

Signed and Sealed this

Twenty-ninth Day of April, 1997

*Attest:*

*Attesting Officer*

BRUCE LEHMAN

*Commissioner of Patents and Trademarks*